US006173709B1

(12) United States Patent
Yokoyama

(10) Patent No.: US 6,173,709 B1
(45) Date of Patent: Jan. 16, 2001

(54) PORTABLE GAS COOKING STOVE

(75) Inventor: Hiroaki Yokoyama, Niigata (JP)

(73) Assignee: Snow Peak, Inc., Niigata (JP)

( * ) Notice: Under 35 U.S.C. 154(b), the term of this patent shall be extended for 0 days.

(21) Appl. No.: 09/482,114

(22) Filed: Jan. 13, 2000

(30) Foreign Application Priority Data

Sep. 17, 1999 (JP) ..... 11-263121

(51) Int. Cl.[7] ..... F24C 3/08

(52) U.S. Cl. ..... 126/40; 126/39 E; 431/191; 431/143

(58) Field of Search ..... 126/40, 38, 41 R, 126/25 R, 39 E; 431/6, 263, 274, 191, 143, 255, 192, 193, 264, 254, 258; 239/555

(56) References Cited

U.S. PATENT DOCUMENTS

| | | | | |
|---|---|---|---|---|
| 221,688 | * | 11/1879 | McDonald et al. | 239/555 |
| 422,166 | * | 2/1890 | Stubbers | 239/555 |
| 901,596 | * | 10/1908 | Detsinyi | 239/555 |
| 1,047,028 | * | 12/1912 | Foster et al. | 126/41 |
| 1,674,631 | * | 6/1928 | Benniger | 239/555 |
| 2,235,635 | * | 3/1941 | Herman | 239/555 |
| 2,621,722 | * | 12/1952 | Abrams | 239/555 |
| 2,625,994 | * | 1/1953 | Shepherd et al. | 239/555 |
| 2,642,934 | * | 6/1953 | Gunther et al. | 126/41 |
| 3,088,271 | * | 5/1963 | Smith | 239/555 |
| 3,592,179 | * | 7/1971 | Hahn | 126/41 |
| 3,758,264 | * | 9/1973 | Fijalkowski | 431/191 |
| 4,288,210 | * | 9/1981 | Leonard et al. | 431/263 |
| 4,302,181 | * | 11/1981 | Schlosser | 431/264 |
| 4,588,373 | * | 5/1986 | Tonon et al. | 126/39 J |
| 4,861,264 | * | 8/1989 | Romanak et al. | 431/263 |
| 4,941,817 | * | 7/1990 | Schlosser | 431/264 |
| 5,513,623 | * | 5/1996 | Hong | 126/40 |
| 5,836,756 | * | 11/1998 | Moss | 431/263 |
| 5,875,974 | * | 3/1999 | Kwiatek | 239/555 |

* cited by examiner

*Primary Examiner*—Ira S. Lazarus
*Assistant Examiner*—David Lee
(74) *Attorney, Agent, or Firm*—Young & Thompson

(57) ABSTRACT

There is provided a portable gas cooking stove, including (a) a mixture gas pipe having an open end through which a mixture gas of combustible gas and air is exhausted, (b) a burner head connected to the mixture gas pipe in a hermetically sealed condition and having at least one opening at a surface thereof, the mixture gas blowing out through the opening, (c) an igniter igniting the mixture gas blowing out through the opening of the burner head, and (d) a windscreen surrounding the burner head and formed with a flame hole facing the opening of the burner head, the igniter being located outside the windscreen in facing relation to the flame hole. The portable gas cooking stove makes it no longer necessary to provide a net to an inner wall of a burner head, which was necessary to do in a conventional gas cooking stove, ensuring reduction in a period of time necessary for fabricating a flame hole and simplification in steps of fabricating a flame hole.

8 Claims, 2 Drawing Sheets

PORTABLE GAS COOKING STOVE

BACKGROUND OF THE INVENTION

1. Field of the Invention

The present invention relates to a so-called outdoor portable gas cooking stove, and more particularly, to a burner structure of a portable gas cooking stove.

2. Description of the Related Art

FIG. 1 shows an example of a portable gas cooking stove known in the art.

Normally, the portable gas cooking stove 10 includes a gas cartridge 11 filled with compressed combustible gas, and a gas burner 12 mounted detachably on the gas cartridge 11. The gas cartridge 11 and the gas burner 12 are coupled to each other in a hermetically sealed condition through a gasket 13.

The gas burner 12 is comprised of a plug fitting 14 which is connected to the gas cartridge 11 and through which combustible gas supplied from the gas cartridge 11 passes, a gas flow adjusting spindle 15 which adjusts a degree of opening of a gas passage formed inside the plug fitting 14 to thereby adjust a flow of the combustible gas passing through the plug fitting 14, a burner head 16 with a number of openings 16*a* and a flame hole 16*b* greater in area than the openings 16*a*, both formed on a surface thereof, a mixing tube 17 connecting the plug fitting 14 to the burner head 16, a plurality of kettle holders 18 that are fixed on the mixing tube 17 and extend over the burner head 16, and an igniter 19 mounted on a support 19*a*.

The flame hole 16*b* is covered with a mesh net.

The portable gas cooking stove 10 having the above-mentioned structure is used as follows.

The combustible gas is filled in the gas cartridge 11 in a pressurized condition. Hence, when the gas passage is made open through the gas flow adjusting spindle 15, the combustible gas in a pressurized condition enters the mixing tube 17 from the gas cartridge 11 through the plug fitting 14. Thus, the combustible gas enters the mixing tube 17 with a gas flow thereof being adjusted by the gas flow adjusting spindle 15.

The mixing tube 17 is formed with a number of openings 17*a* (only one of them is illustrated in FIG. 1). External air is absorbed into the mixing tube 17 through the openings 17*a* by virtue of negative pressure produced when the combustible gas passes through the mixing tube 17. The combustible gas is mixed with air entering the mixing tube 17 through the openings 17*a*, into a gas mixture of the combustible gas and air.

After entering the burner head 16, the gas mixture is discharged through both the openings 16*a* and the flame hole 16*b*. The mixture gas having been discharged from the flame hole 16*b* is ignited by the electric igniter 19 located in the vicinity of the burner head 16, and the mixture gas having been discharged through the openings 16*a* is also ignited by virtue of ignition of the mixture gas discharged through the flame hole 16*b*.

Flame of burning gas mixture heats an object to be heated such as a pan, kettle, food, etc., put on the kettle holders 18.

The flame hole 16*b* is formed generally by the steps of forming a hole at a surface of the burner head 16, and covering the hole with a mesh net at an inner wall of the burner head 16.

However, since the burner head 16 is generally small in size, it is a laborious step to cover a hole formed at a surface of the burner head 16, with a mesh net at an inner wall of the burner head 16. Accordingly, the step of fabricating the burner head 16 takes much time and much labor.

SUMMARY OF THE INVENTION

In view of the above-mentioned problem in the conventional gas cooking stove, it is an object of the present invention to provide a gas cooking stove which is capable of shortening a period of time necessary for fabricating a flame hole and simplifying a step of fabricating a flame hole.

There is provided a portable gas cooking stove, including (a) a mixture gas pipe having an open end through which a mixture gas of combustible gas and air is exhausted, (b) a burner head connected to the mixture gas pipe in a hermetically sealed condition and having at least one opening at a surface thereof, the mixture gas blowing out through the opening, (c) an igniter igniting the mixture gas blowing out through the opening of the burner head, and (d) a windscreen surrounding the burner head and formed with a flame hole facing the opening of the burner head, the igniter being located outside the windscreen in facing relation to the flame hole.

In the portable gas cooking stove in accordance with the present invention, the windscreen surrounding the burner head is formed with a flame hole at which mixture gas of combustible gas and air is ignited. Accordingly, it is no longer necessary to cover a hole formed at a surface of the burner head 16, with a mesh net at an inner wall of the burner head 16. This ensures fabrication of a flame hole in a shorter period of time and with less labor.

It is preferable that the flame hole is covered with a net.

The flame hole may be in the various forms. For instance, the flame hole may be comprised of a plurality of slits. As an alternative, the flame hole may be comprised of a plurality of holes randomly located in the windscreen.

It is preferable that holes are formed in a circular area.

It is preferable that the windscreen has a height higher than a summit of the burner head.

It is preferable that the windscreen is annular.

It is preferable that the burner head is comprised of planar plates and waveform plates alternately stacked one on another, the mixture gas being horizontally blown out through gaps formed between the planar plates and the waveform plates.

The burner head having the above-mentioned structure ensures that mixture gas is horizontally blown out, namely, towards the windscreen. Hence, the mixture gas perpendicularly enters the flame hole, and as a result, can be readily ignited by the igniter. In addition, since the mixture gas reaches the flame hole in minimum period of time, the mixture gas can be immediately ignited.

After the mixture gas has been ignited, the flame hole becomes red by flame. Hence, even if it were bright around the portable gas cooking stove, it would be possible to readily confirm that the mixture gas is burning, in comparison with a conventional gas cooking stove in which a flame hole is formed at a surface of a burner head. Thus, the portable gas cooking stove in accordance with the present invention enhances much safety in use relative to a conventional gas cooking stove.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Figure 2:
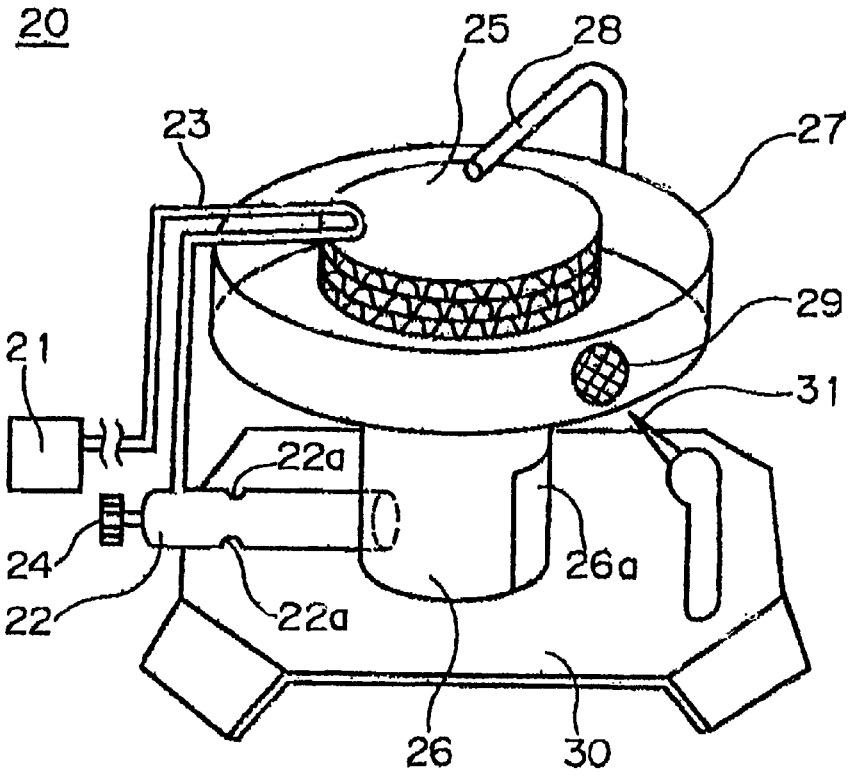
FIG. 2 is a perspective view of a gas cooking stove in accordance with a preferred embodiment of the present invention.

FIG. 2 illustrates a portable gas cooking stove in accordance with a preferred embodiment of the present invention.

As illustrated in FIG. 2, the gas cooking stove 20 is comprised of a gas cartridge 21 filled with pressurized combustible gas, a plug fitting 22 adjusting a flow of the combustible gas supplied from the gas cartridge 21, a gas tube 23 through which the combustible gas is supplied from the gas cartridge 21 to the plug fitting 22, a gas flow adjusting spindle 24 which adjusts a degree of opening of a gas passage formed inside the plug fitting 22 to thereby adjust a flow of the combustible gas passing through the plug fitting 22, a burner head 25 which has a circular latitudinal cross-section and which blows out mixture gas of combustible gas and air therethrough, a mixing tube 26 connecting the plug fitting 22 to the burner head 25, a annular windscreen 27 having a bottom and surrounding the burner head 25, a plurality of kettle holders 28 (only one of them is illustrated in FIG. 2 for simplification of FIG. 2) each fixed at one end thereof to the mixing tube 26 and extending above the burner head 25, a flame hole 29 comprised of a mesh net covering therewith a circular opening formed at a annular wall of the windscreen 27, a base 30 on which the mixing tube 26 is mounted, and an igniter 31 mounted on the base 30 and located outside the windscreen 27 in facing relation to the flame hole 29.

The gas tube 23 is partially bent such that a part of the gas tube 23 is located quite close to the burner head 25.

Figure 3:
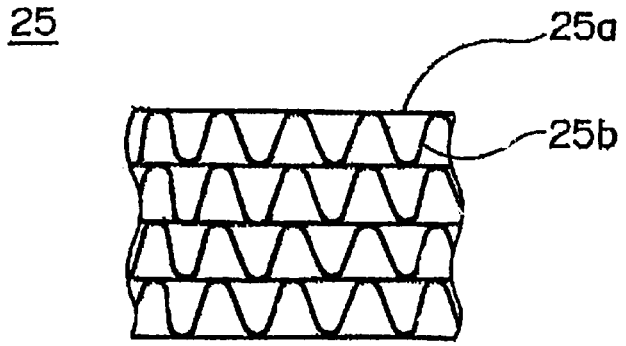
FIG. 3 is a cross-sectional view of the burner head.

FIG. 3 is a cross-section of a peripheral portion of the burner head 25.

As illustrated in FIG. 3, the burner head 25 is designed to have a structure where plan plates 25*a* and waveform plates 25*b* are alternately stacked. As mentioned later, mixture gas supplied into the burner head 25 through the mixing tube 26 is horizontally discharged through gaps formed between the plan plates 25*a* and the waveform plates 25*b*.

The windscreen 27 is designed to be either level with an upper surface of the burner head 25 or slightly higher than an upper surface of the burner head 25.

The base 30 is made of a mirror-reflecting plate such as stainless steel in order to disallow heat to escape to an area below the portable gas cooking stove 20.

The portable gas cooking stove 20 in accordance with the embodiment is used as follows.

Combustible gas is filled in the gas cartridge 21 under pressure. Hence, when a gas passage formed in the plug fitting 22 is made open by means of the gas flow adjusting spindle 24, combustible gas under pressure enters the plug fitting 22 from the gas cartridge 21 through the gas tube 23.

Since the gas tube 23 has a portion which is bent so that the portion is close to the burner head 25, the combustible gas passing through the bent portion of the gas tube 23 is heated by flame blowing out from the burner head 25, and hence, is likely to be gasified.

The plug fitting 22 is formed with a plurality of openings 22*a* through which external air is introduced into the plug fitting 22. Negative pressure produced when the combustible gas passes through the plug fitting 22 causes external air to be absorbed into the plug fitting 22 through the openings 22*a*. The combustible gas is mixed with the thus absorbed air in the plug fitting 22. Thus, there is produced mixture gas of the combustible gas and air.

As mentioned above, the combustible gas is mixed with air with a gas flow thereof being adjusted by means of the gas flow adjusting spindle 24, and then, enters the mixing tube 26.

The mixing tube 26 is formed at a wall thereof with a mixture gas collision plate 26*a* in facing relation to an exhaust port of the plug fitting 22. The mixture gas exhausted into the mixing tube 26 from the plug fitting 22 collides with the mixture gas collision plate 26*a*, and as a result, diffuses and raises in the mixing tube 26.

The mixture gas enters the burner head 25 at a center thereof, and radially diffuses towards a periphery of the burner head 25. Then, the mixture gas is discharged from the burner head 25 through gaps formed between the planar plates 25*a* and the waveform plates 25*b*.

A portion of the mixture gas exhausted from the burner head 25, existing in the vicinity of the flame hole 29, is ignited by the igniter 31. If the portion of the mixture gas is ignited, flame of the portion of the mixture gas is diffused to the rest of the mixture gas, resulting in that the mixture gas filled in the windscreen 27 starts burning.

Flame of the burning gas mixture heats an object to be heated such as a pan, kettle, food, etc., put on the kettle holders 28.

As explained above, in the portable gas cooking stove 20 in accordance with the embodiment, the windscreen 27 surrounding the burner head 25 is formed with the flame hole 29, and the igniter 31 is located outside the windscreen 27 in facing relation to the flame hole 29. Accordingly, it is no longer necessary to cover the flame hole 29 with a mesh net at an inner wall of the burner head 25. This ensures fabrication of the flame hole 29 in a shorter period of time and with less labor.

Since the burner head 25 is designed to have a multi-layered structure comprised of the planar plates 25*a* and the waveforms 25*b* such that mixture gas is horizontally discharged, the mixture gas perpendicularly reaches the flame hole, and as a result, can be readily ignited by the igniter. In addition, since the mixture gas reaches the flame hole 29 in a minimum period of time, the mixture gas can be immediately ignited.

Figure 1:
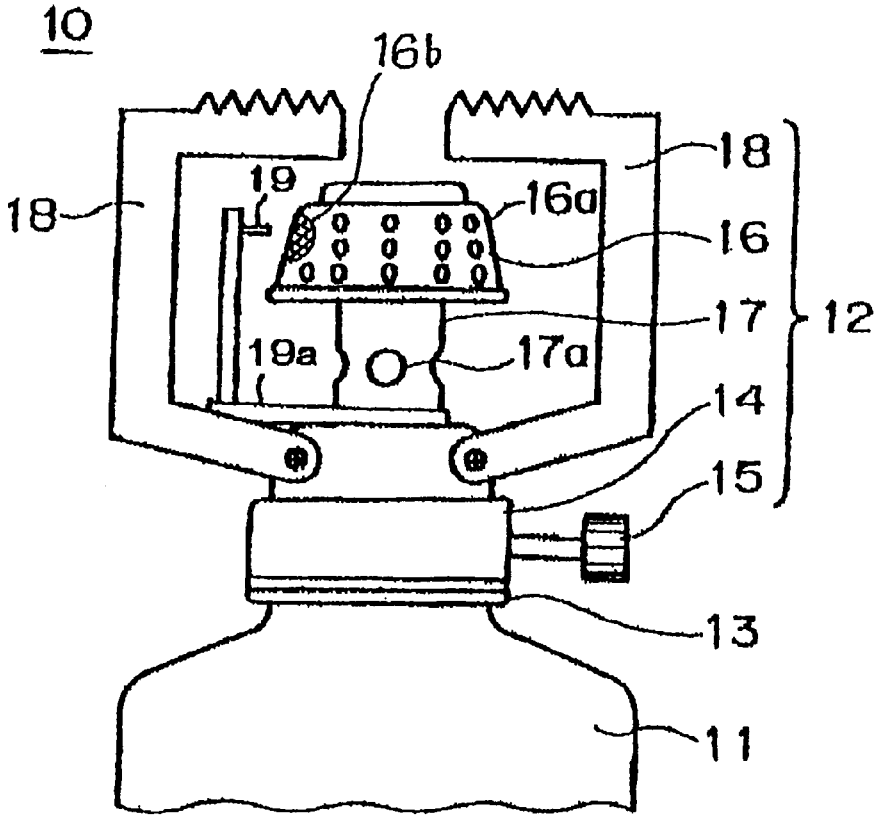
FIG. 1 PRIOR ART
FIG. 1 is a front view of a conventional portable gas cooking stove.

After the mixture gas has been ignited, the flame hole 29 becomes red by flame. Hence, even if it is bright around the portable gas cooking stove 20, it would be possible to readily confirm that the mixture gas is burning, in comparison with the conventional gas cooking stove 10, illustrated in FIG. 1, in which the flame hole 19 is formed at a surface of the burner head 16. Thus, the portable gas cooking stove 20 enhances much safety in use relative to the conventional gas cooking stove 10.

In the above-mentioned embodiment, the flame hole 29 is formed as a circular hole covered with a mesh net. As an alternative, the flame hole 29 may be formed either as a plurality of slits or as a number of small holes formed randomly in a certain area such as a circular area at a wall of the windscreen 27.

In the above-mentioned embodiment, combustible gas supplied from the gas cartridge 21 is used as fuel. As an alternative, there may be used other combustible liquid fuel such as gaseous gasoline.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 11-263121 filed on Sep. 17, 1999 including specification, claims, drawings and summary is incorporated herein by reference in its entirety.

What is claimed is:

1. A portable gas cooking stove, comprising:

(a) a mixture gas pipe having an open end through which a mixture gas of combustible gas and air is exhausted;

(b) a burner head connected to said mixture gas pipe in a hermetically sealed condition and having at least one opening at a surface thereof, said mixture gas blowing out through said opening;

(c) an igniter igniting said mixture gas blowing out through said opening of said burner head; and (d) a windscreen surrounding said burner head and formed with a flame hole facing said opening of said burner head, said igniter being mounted to said stove and having an open non-enclosed spark end located outside said windscreen in facing relation to said flame hole, said mixture gas being ignited by applying a spark from said open non-enclosed spark end to said mixture gas that has exited through said flame hole.

2. The portable gas cooking stove as set forth in claim 1, wherein said flame hole is covered with a net.

3. The portable gas cooking stove as set forth in claim 1, wherein said flame hole is comprised of a plurality of slits.

4. The portable gas cooking stove as set forth in claim 1, wherein said flame hole is comprised of a plurality of holes randomly located in said windscreen.

5. The portable gas cooking stove as set forth in claim 4, wherein said holes are formed in a circular area.

6. The portable gas cooking stove as set forth in claim 1, wherein said windscreen has a height higher than a summit of said burner head.

7. The portable gas cooking stove as set forth in claim 1, wherein said windscreen is annular.

8. The portable gas cooking stove as set forth in claim 1, wherein said burner head is comprised of planar plates and waveform plates alternately stacked one on another, said mixture gas being horizontally blown out through gaps formed between said planar plates and said waveform plates.

* * * * *